US005265572A

United States Patent [19]

Kadomukai et al.

[11] Patent Number: 5,265,572

[45] Date of Patent: Nov. 30, 1993

[54] THROTTLE ACTUATOR

[75] Inventors: Yuzo Kadomukai, Ibaraki; Teruhiko Minegishi, Katsuta; Eiji Sato, Ibaraki; Naoyuki Tanaka, Abiko, all of Japan

[73] Assignees: Hitachi, Ltd., Tokyo; Hitachi Automotive Engineering Co., Ltd., Ibaraki, Japan

[21] Appl. No.: 885,776

[22] Filed: May 20, 1992

[30] Foreign Application Priority Data

May 20, 1991 [JP] Japan ..... 3-114419

[51] Int. Cl.[5] ..... F02D 9/02; F02D 9/08; F23N 3/00

[52] U.S. Cl. ..... 123/396; 123/399

[58] Field of Search ..... 123/396, 399, 400

[56] References Cited

U.S. PATENT DOCUMENTS

| | | | |
|---|---|---|---|
| 4,548,176 | 10/1985 | Ishida et al. | 123/396 |
| 4,776,563 | 10/1988 | Pascall | 123/396 |
| 4,848,505 | 7/1989 | Yoshizawa et al. | 123/396 |
| 4,892,071 | 1/1990 | Asayama | 123/399 |
| 4,895,343 | 1/1990 | Sato | 123/396 |
| 4,961,355 | 10/1990 | Irina et al. | 123/399 |
| 5,002,032 | 3/1991 | Kolberg | 123/399 |
| 5,016,589 | 5/1981 | Terazawa | 123/399 |
| 5,018,496 | 5/1991 | Buchl | 123/399 |
| 5,022,369 | 6/1991 | Terazawa | 123/399 |
| 5,035,218 | 6/1991 | Takeuchi et al. | 123/399 |
| 5,040,508 | 8/1991 | Watanabe | 123/399 |
| 5,048,485 | 9/1991 | Terazawa et al. | 123/399 |
| 5,065,722 | 11/1991 | Huber et al. | 123/399 |
| 5,074,266 | 12/1991 | Kuhn et al. | 123/399 |
| 5,107,811 | 4/1992 | Huber et al. | 123/399 |
| 5,113,822 | 5/1992 | Asayama | 123/399 |
| 5,121,727 | 6/1992 | Kramer et al. | 123/399 |
| 5,131,362 | 7/1992 | Simon et al. | 123/396 |
| 5,131,364 | 7/1992 | Mann | 123/399 |

*Primary Examiner*—E. Rollins Cross
*Assistant Examiner*—Thomas N. Maulis
*Attorney, Agent, or Firm*—Antonelli, Terry, Stout & Kraus

[57] ABSTRACT

A throttle actuator comprising: a body which forms an intake passage; a throttle valve shaft; a throttle valve which is connected to the throttle valve shaft and which adjusts the opening of the intake passage; and a motor which applies torque to the throttle valve shaft. The throttle valve is provided with: a valve shaft lever; an accelerator lever which is operated by means of the accelerator pedal; a floating lever which is positioned between the valve shaft lever and the accelerator lever and which transmits torque to the valve shaft lever in such a direction that the throttle valve opens; a valve returning spring which applies torque to the throttle valve shaft in such a direction that the throttle valve closes; a coupler spring which pulls the accelerator lever and the floating lever toward each other; and an accelerator lever returning spring which applies torque to the accelerator lever in such a direction that the throttle valve closes. A difference between the amount of operation caused by the action of the accelerator pedal and the amount of operation caused by the motor is offset by the relationships between the set positions of floating lever and the coupler spring and between the set positions of the floating lever and the valve shaft lever.

10 Claims, 8 Drawing Sheets

THROTTLE ACTUATOR

BACKGROUND OF THE INVENTION

The present invention relates to a throttle actuator for controlling the amount of gas suctioned into an engine and, more particularly, to an electronically controlled throttle actuator in which control operation is made more precise and flexible so as to favorably ensure safe driving even when a failure occurs in the control mechanism or in a control device.

In a conventional electronically controlled throttle actuator, opening of a throttle valve is adjusted by operation of an accelerator pedal transmitted by means of an accelerator cable, which operation is supplemented by operation of an electronically controlled motor, as disclosed, e.g. in Japanese Patent Laid-Open No. 62-186022.

In the throttle actuator disclosed in Japanese Patent Laid-Open No. 62-186022, the throttle operation is performed mainly with the accelerator pedal. Normally, the motor is kept at a position such that no torque is transmitted from the motor to a throttle shaft. When needed, the motor is rotated to a position such that torque is transmitted to the throttle shaft, and then the motor controls the opening of the throttle valve. Thus, there are unsatisfactory features: response delay is likely during the initiation of the throttle control; a minute angle adjustment of the opening is not easy to perform; and at initiation of torque conduction from the motor to the throttle shaft, an impact caused by the inertia force of the motor transmits to the driver through the accelerator pedal.

SUMMARY OF THE INVENTION

It is the first object of the present invention to provide a throttle actuator which improves throttle operation control performed by an actuator, such as a motor, and whose operation does not cause an undesired impact upon the driver.

The second object of the present invention is to provide a throttle actuator comprising fail-safe means and/or limp home means which safeguard normal driving from a failure of the actuator or a failure of a control unit which drives the actuator.

To achieve the first object, a throttle actuator according to the present invention comprises: a body which forms an intake passage; a throttle valve shaft; and a throttle valve which is connected to the throttle valve shaft and which adjusts the opening of the intake passage. The throttle valve is provided with: a valve shaft lever; an accelerator lever which is operated by means of the accelerator pedal; a floating lever which is positioned between the valve shaft lever and the accelerator lever and which transmits torque to the valve shaft lever in such a direction that the throttle valve opens; a valve returning spring which applies torque to the throttle valve shaft in such a direction that the throttle valve closes; and a coupler spring which pulls the accelerator lever and the floating lever toward each other. The throttle actuator may further comprise: an accelerator lever returning spring which applies torque to the accelerator lever in such a direction that the throttle valve closes; and a motor which applies torque to the throttle valve shaft.

Also, in the above-described throttle actuator, the spring constant of the coupler spring is smaller than the sum of the spring constants of the valve returning spring and the accelerator lever returning spring.

Further, the torque which is generated by the initial deformation of the above-described coupler spring so as to pull the accelerator lever and the floating lever toward each other, is greater than the torque which the valve returning spring generates when the throttle valve is fully open.

To achieve the second object, a throttle actuator according to the present invention comprises: a body which forms an intake passage; a throttle valve shaft; a throttle valve which is connected to the throttle valve shaft and which adjusts the opening of the intake passage; an electronically controlled motor for adjusting the opening of the throttle valve in accordance with a throttle operation which is performed by means of an accelerator pedal; and an electromagnetic clutch which is provided on the throttle valve shaft and which operates the torque transmission from the motor to the throttle valve shaft. The electromagnetic clutch is disengaged when it is determined that a failure occurs in the electronically controlled motor.

The above-described throttle actuator may further comprise a motor returning spring which applies torque to the motor which causes the throttle valve to close.

Further, the torque which is generated by the initial deformation of the coupler spring so as to pull the accelerator lever and the floating lever toward each other is greater than the sum of the torques which the valve returning spring and the motor returning spring generate when the throttle valve is fully open.

During normal operation of the throttle actuator according to the present invention, the electromagnetic clutch is kept engaged so that the motor will take the main role in throttle operation. A difference between the amount of operation caused by the action of the accelerator pedal and the amount of operation caused by the motor is offset by the relationship between the set positions of floating lever and the coupler spring and between the set positions of the floating lever and the valve shaft lever. In detail, if the operation caused by the action of the accelerator pedal is greater than the operation caused by the motor, the difference is offset by extension of the coupler spring. If the operation caused by the action of the accelerator pedal is smaller than the operation caused by the motor, the torque in the direction such as to open the throttle valve is not transmitted to the accelerator pedal because of the relative positions of the valve shaft lever and the floating lever. Thus, the throttle control performed by means of the motor does not cause any undesired impact upon the driver.

If the motor or the control unit which drives the motor fails, fail-safe function and/or limp-home function safeguard the normal driving. For example, if the motor of the control unit fails to perform a predetermined throttle operation, the electromagnetic clutch disconnects the motor from the throttle valve shaft so that the throttle can be controlled solely by means of accelerator pedal. Thus, normal driving can be continued after such a failure occurs.

The further objects, features and advantages of the present invention will become apparent in the below description of the preferred embodiments with reference to the attached drawings.

DESCRIPTION OF THE PREFERRED EMBODIMENTS

Embodiments of the present invention will be described hereinafter with reference to the drawings.

Figure 1:
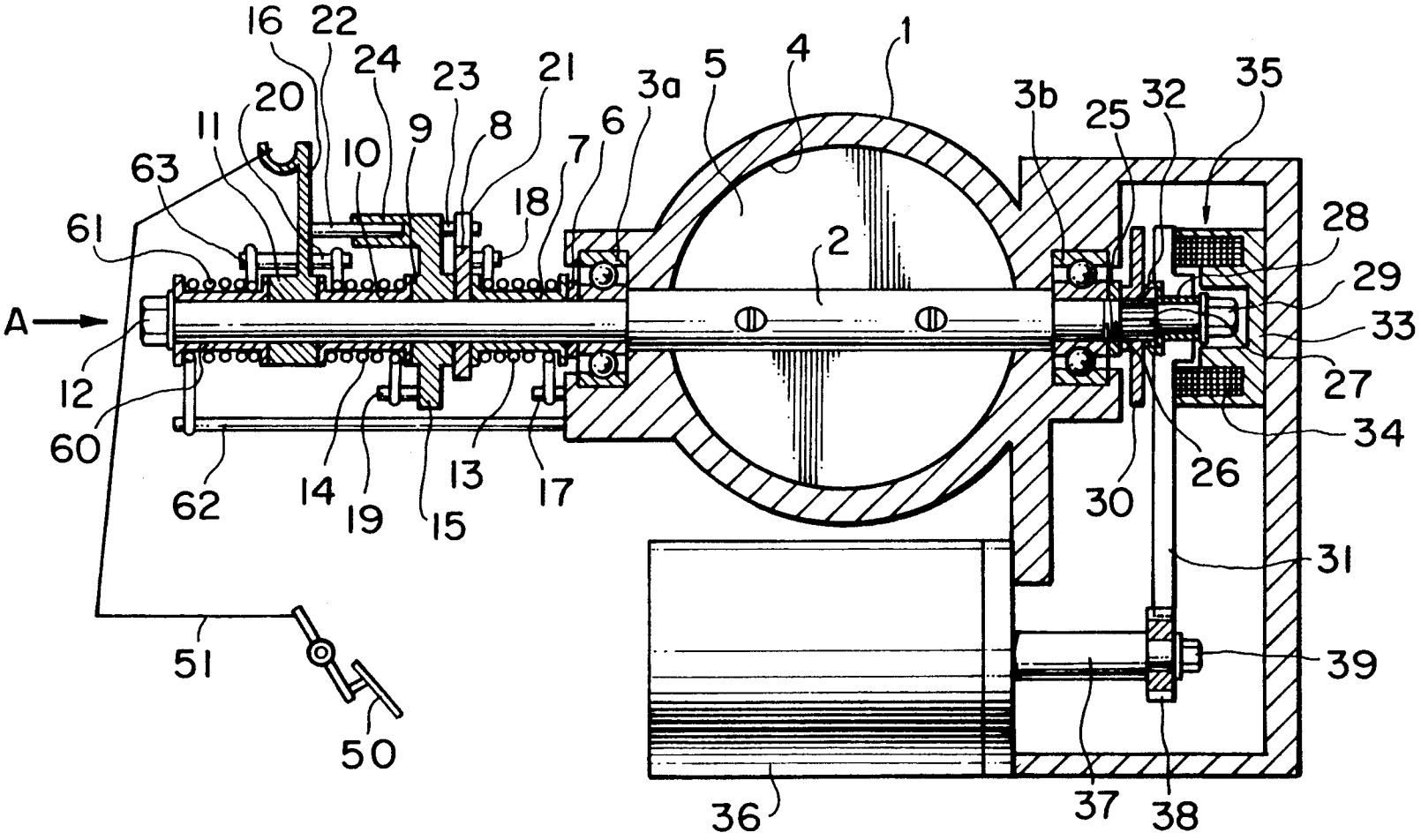
FIG. 1 is a longitudinal sectional view of a throttle actuator according to the first embodiment of the present invention.

The first embodiment will be described with reference to FIGS. 1 through 10. As shown in FIG. 1, a body 1 supports other members and forms an intake passage 4. The body 1 supports a throttle valve shaft 2 by means of bearings 3*a* and 3*b*. Inner races of the bearings 3*a* and 3*b* are held on the throttle valve shaft 2 by means of a bearing cap 6 and 25 respectively, the latter being fitted on a threaded portion 26. The throttle valve shaft 2 is connected to a throttle valve 5, which adjusts the opening of the intake passage 4 formed inside the body 1.

The throttle valve shaft 2 extends to both sides of the body 1. A spring collar 7, a valve shaft lever 8, a bearing 9, a spring collar 10, bearing 11 and a spring collar 60 are firmly connected to one end portion of the throttle valve shaft 2, at one side of the bearing cap 6 (the left side thereof in FIG. 1), by means of a nut 12. A valve returning spring 13, a coupler spring 14 and an accelerator lever returning spring 61 are loosely fitted over the spring collars 7, 10 and 60, respectively. A floating lever 15 and an accelerator lever (the second lever) 16 are connected to outer peripheries of the bearings 9 and 11, respectively, so that levers 15 and 16 are rotatable relatively to the throttle valve shaft 2. The second lever 16 is rotated by operation of an accelerator pedal 50 through an accelerator cable 51.

The two ends of valve returning spring 13 are held by pins 17 and 18 which are rooted in the body 1 and the valve shaft lever 8, respectively. The valve returning spring 13 applies torque to the throttle valve shaft 2 in a direction such as to close the throttle valve 5 (counterclockwise when viewed from the direction indicated by the arrow A in FIG. 1). The two ends of the coupler spring 14 are held by pins 19 and 20 which are rooted in the floating lever 15 and the accelerator lever 16, respectively. The coupler spring 14 provides torque such that the floating lever 15 and the accelerator lever 16 are pulled against each other. The two ends of accelerator lever returning spring 61 are held by pins 62 and 63 which are rooted in the body 1 and the accelerator lever 16, respectively. The accelerator lever returning spring 61 gives the accelerator lever 16 torque in a direction such as to close the throttle valve 5 (counterclockwise when viewed from the direction indicated by the arrow A in FIG. 1).

Though the accelerator lever returning spring 61 is not essential, it has the advantage of quickening the response of the throttle valve 5.

If the accelerator lever returning spring 61 is not provided, the torque which causes the accelerator lever 16 to rotate in a direction such that the throttle valve 5 closes (the direction of closing) is transmitted from the valve shaft lever 8, floating lever 15 and the coupler spring 14 to the accelerator lever 16. Thus, the response of the accelerator lever 16 to a movement in the closing direction slows down. Hindered by movement of the accelerator lever 16, the response of the throttle valve 5 to a movement in the direction of closing also becomes slow.

Figure 2:
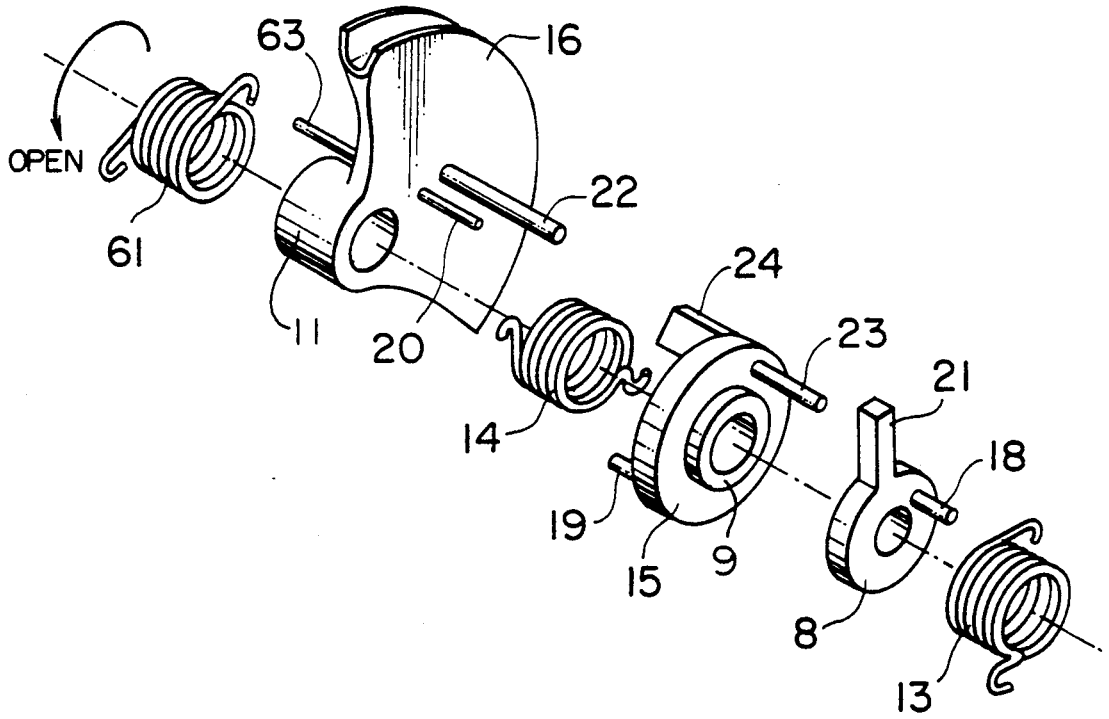
FIG. 2 is a perspective view of engaging members of a throttle actuator according to the present invention.

As shown in FIG. 2, according to this embodiment: the valve shaft lever 8 is provided with an engaging portion 21 for the floating lever 15; the accelerator lever 16 is provided with an engaging portion 22 for the floating lever 15; and the floating lever 15 is provided with an engaging portion 23 for the valve shaft lever 8 and an engaging portion 24 for the accelerator lever 16. The engaging portions 21 and 23 of valve shaft lever 8 and the floating lever 15 are arranged so that the torque in the direction such as to open the throttle valve 5 (clockwise when viewed from the direction indicated by the arrow A in FIG. 1) can be transmitted solely in the direction from the floating lever 15 to the valve shaft lever 8, and so that the torque in the direction such that the throttle valve 5 closes (counterclockwise when viewed from the direction indicated by the arrow A in FIG. 1) can be transmitted solely in the direction from the valve shaft lever 8 to the floating lever 15. The engaging portions 22 and 24 of the second (accelerator) lever 16 and the floating lever 15 are arranged so that the torque in the direction such that the throttle valve 5 closes (counterclockwise when viewed from the direction indicated by the arrow A in FIG. 1) can be transmitted solely in the direction from the second lever to the floating lever 15 by means of engagement between the engaging portions 22 and 24. The torque in the direction such as to open the throttle valve 5 (clockwise when viewed from the direction indicated by the arrow A in FIG. 1) is transmitted by means of the coupler spring 14. Since the torque of the accelerator lever returning spring 61 acts directly on the accelerator lever 16, the response of the accelerator lever 16 to movement in the closing direction is substantially speeded up. Since the accelerator lever 16 does not hinder the movement of the throttle valve 5, the response of the throttle valve 5 is also substantially quickened.

A bearing 28 is firmly connected to the other end portion of the throttle valve shaft 2, at one side of the bearing cap 25 (the right side thereof in FIG. 1), by means of a nut 29. A spline portion 27 is provided on the throttle valve shaft 2, between the bearing cap 25 and the bearing 28. A movable disc 30 is loosely fitted on the spline portion 27 so as to be movable in the axial direction of the throttle valve shaft 2. A sector gear 31 is connected to the circumference of the bearing 28 so as to be rotatable with respect to the throttle valve shaft 2. A plate spring 32 is provided between the bearing 28 and the movable disc 30 so as to push the movable disc 30 away from the bearing 28 (to the left in FIG. 1). A set of a yoke 33 and a coil 34 is fixed on a portion of the body 1 facing the right-hand-side (in FIG. 1) end of the throttle valve shaft 2. The yoke 33, the coil 34, the movable disc 30, the plate spring 32 and the sector gear 31 constitute an electromagnetic clutch 35. The magnetic path is formed of the yoke 33, the sector gear 31 and the movable disc 30. When the coil 34 is supplied with electric current, the electromagnetic force generated thereby surpasses the restoration force of the plate spring 32 so that the movable disc 30 is pulled into contact with the sector gear 31. Thus, torque can be transmitted from the sector gear 31 to the throttle valve shaft 2 by means of the friction force between the movable disc 30 and the sector gear 31. When the current in the coil 34 is discontinued, the movable disc 30 is pushed away from the sector gear 31 by the restoration force of the plate spring 32. Thus, the torque transmission from the sector gear 31 to the throttle valve shaft 2 is cut off. A motor 36 is fixed to the body 1. A motor shaft 37 thereof is connected, by a nut 39, to a pinion 38 which engages with the sector gear 31.

Operation of the thus-constructed throttle actuator will be described.

During normal operation, i.e. when the motor and a control unit for driving the motor are in normal operation, the coil 34 of the electromagnetic clutch 35 is supplied with current, and thus, the throttle valve shaft 2 and the motor 36 are drivingly connected.

Figure 3:
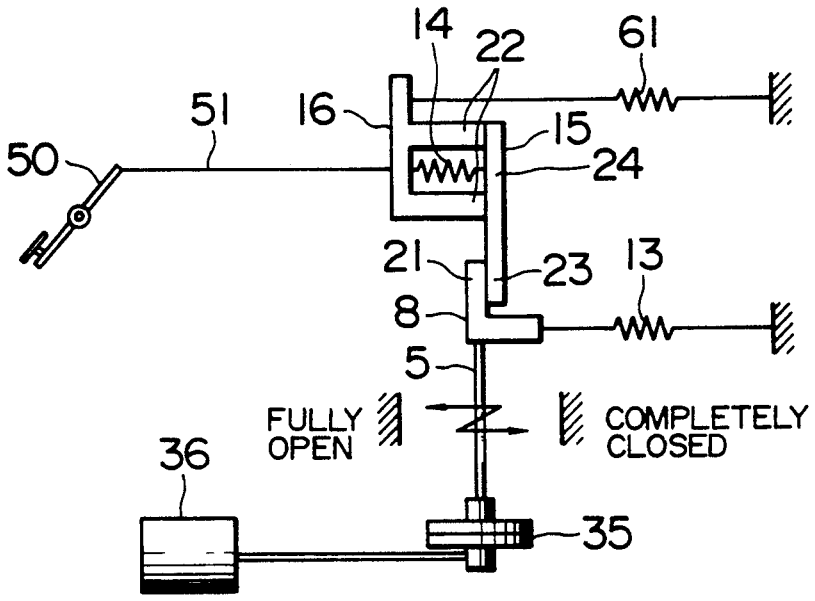
FIG. 3 is a schematic diagram of the throttle actuator shown in FIG. 1, illustrating operation thereof.
Figure 4:
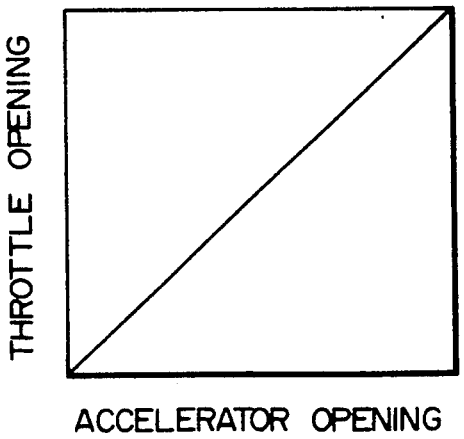
FIG. 4 is a graph showing the relationship between an accelerator opening and a throttle opening when the throttle is controlled so that the throttle opening equals the accelerator opening.

Operation of the throttle actuator when there is no particular throttle control, such as the case in which traction control or cruising speed control is not performed, will be described with reference to FIG. 3. In the figure, rotational movements in the first embodiment shown in FIG. 1 are modified into linear movements for simplification of illustration. To obtain a characteristic in which displacement of the accelerator pedal 50 (referred to as "accelerator opening" hereinafter) is in proportion to opening of the throttle valve 5 (referred to as "throttle opening" hereinafter), rotational angle of the motor 36 must be controlled so that an accelerator opening signal from a sensor (not shown) which detects the accelerator opening coincides with a throttle opening signal from a sensor which detects the throttle opening. Since the accelerator opening, i.e. rotational angle of the accelerator lever 16, is equal to rotational angle of the throttle valve shaft 2, the valve lever 8, the accelerator lever 16 and the floating lever 15 rotate in contact with one another at the engaging portions 21, 22, 23 and 24 thereof. Since the sole purpose of the motor 36 is to maintain the throttle opening equal to the accelerator opening, the torque caused by the driver stepping on the accelerator pedal 50 offsets the torque generated by the valve returning spring 13 and accelerator lever returning spring 61 in such a direction that the throttle valve 5 closes. When the above-described control is performed, the throttle opening varies in proportion to the accelerator opening, as shown in FIG. 4.

Next, operation during throttle control such as the case in which traction control or cruising speed control is performed will be described with reference to FIGS. 5 to 9.

Figure 5:
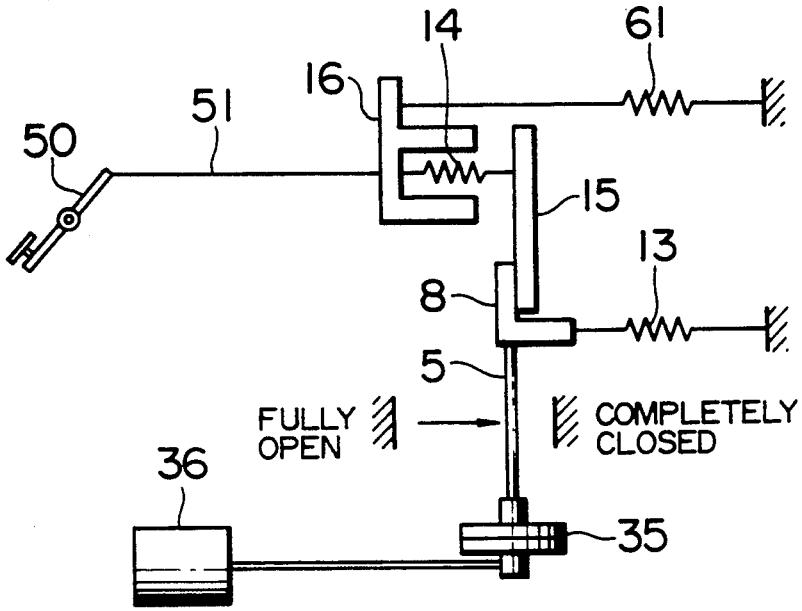
FIG. 5 is a schematic diagram of the throttle actuator as shown in FIG. 3, illustrating operation thereof when the throttle is controlled so that the throttle opening is smaller than the accelerator opening.
Figure 6:
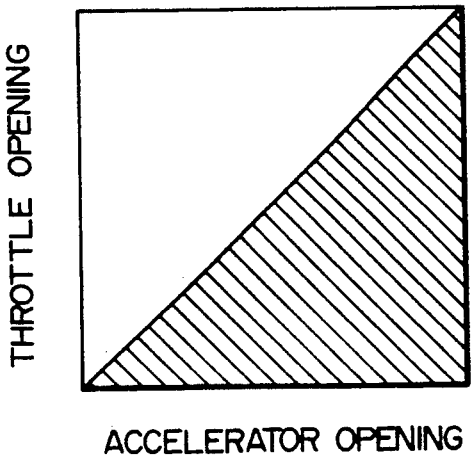
FIG. 6 is a graph showing the relationship between the accelerator opening and the throttle opening when the throttle is controlled so that the throttle opening is smaller than the accelerator opening.

FIG. 5 shows an example of the relative positions of the valve shaft lever 8, accelerator lever 16 and the floating lever 15 during throttle control such as traction control in which the throttle opening is maintained smaller than the accelerator opening. FIG. 6 shows the relation between the accelerator opening and the throttle lever opening during such a control as to reduce the opening of the throttle valve. The shadowed area in FIG. 6 shows the possible range of a combination of the throttle opening and the accelerator opening caused by such control.

The throttle opening, i.e. the opening of the throttle valve 5 operated by the motor 36, is controlled so as to be smaller than the accelerator opening, i.e. the opening of the accelerator lever 16. The difference between these openings is offset by extension of the coupler spring 14. In this case, a change in the reaction force the driver receives from the accelerator pedal 50 is equal to the torque generated by the coupler spring 14. Thus, if a coupler spring 14 is employed whose spring constant is smaller than the sum of the spring constants of the valve returning spring 13 and the accelerator lever returning spring 61, the amount of the above-described change caused by the throttle control can be made substantially smaller in comparison with the total reaction force from the accelerator pedal 50 to the driver; in other words, it can be reduced to a level at which the driver hardly feels the change. Thus, even when the throttle opening is made smaller than the accelerator opening during the throttle control, there is almost no possibility of causing any undesired impact on the driver.

Figure 7:
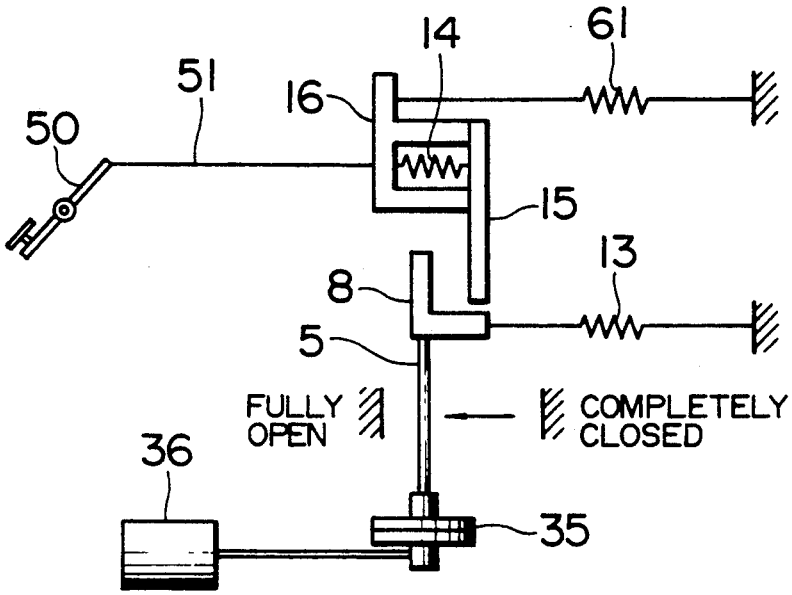
FIG. 7 is a schematic diagram of the throttle actuator as shown in FIG. 3, illustrating operation thereof when the throttle is controlled so that the throttle opening is larger than the accelerator opening.
Figure 8:
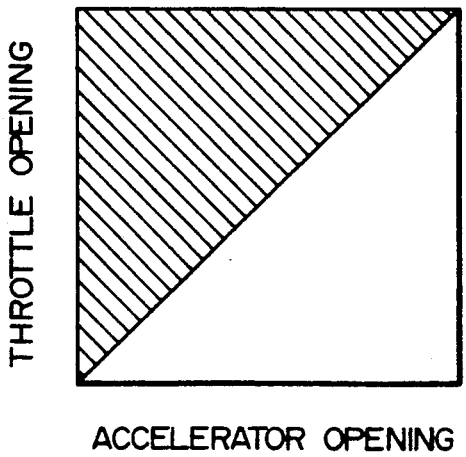
FIG. 8 is a graph showing the relationship between the accelerator opening and the throttle opening when the throttle is controlled so that the throttle opening is larger than the accelerator opening.

FIG. 7 shows an example of the relative positions of the valve shaft lever 8, accelerator lever 16 and the floating lever 15 during throttle control, such as cruising speed control, in which the throttle opening is maintained larger than the accelerator opening. FIG. 8 shows the relation between the accelerator opening and the throttle lever opening during such control as to increase the opening of the throttle valve. The shadowed area in FIG. 8 shows the possible range of a combination of the throttle opening and the accelerator opening caused by such control.

The throttle opening, i.e. the opening of the throttle valve 5 operated by the motor 36, is controlled so as to become larger than the accelerator opening, i.e. the opening of the accelerator lever 16. As described above, the valve shaft lever 8 and the floating lever 16 are arranged so that the valve shaft lever 8 can transmit torque to the floating lever 15 solely in a direction to close the throttle valve 5 (to the left in FIG. 7). Therefore, even if the throttle opening is made larger than the accelerator opening by the throttle control, the difference between the openings is not transmitted to the accelerator lever 16, which is connected to the accelerator pedal 50. Thus, even during a throttle control such that the throttle opening is made larger than the accelerator opening, it is highly unlikely to cause any undesired impact on the driver.

Figure 9:
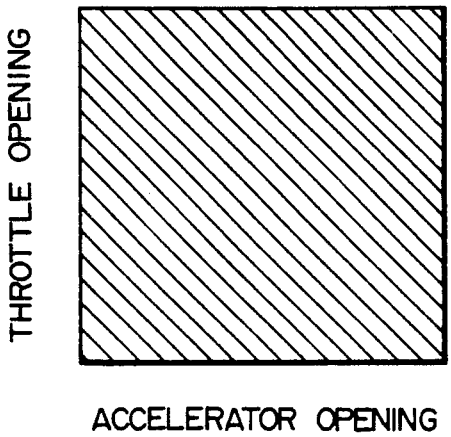
FIG. 9 is a graph showing the relationship between the accelerator opening and the throttle opening when the throttle actuator according to the present invention performs throttle control.

As a result, in the throttle actuator according to the first embodiment of the present invention, the throttle opening can be adjusted within the full range, regardless of the accelerator opening, by means of the throttle control, as shown by the shadowed area in FIG. 9, and there is almost no possibility of causing any undesired impact on the driver.

Next, fail-safe function and limp-home function will be described, which operate when a failure occurs in the motor or in the control unit which drives the motor.

Figure 10:
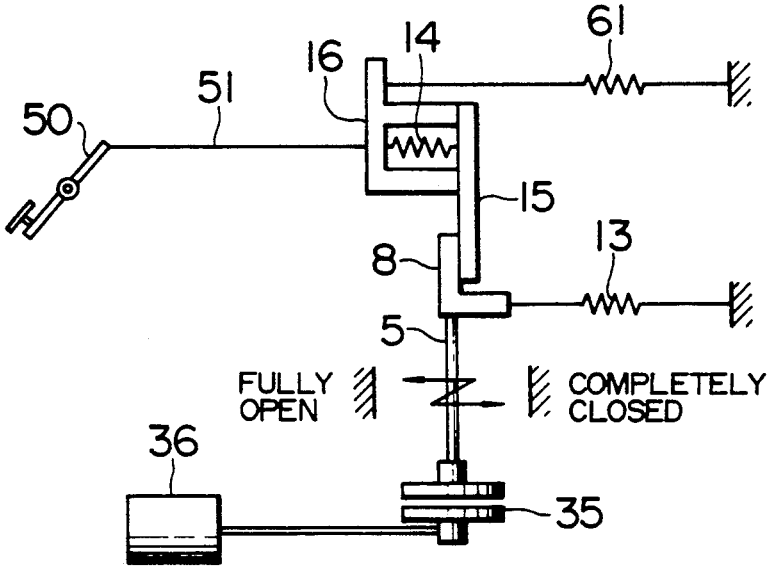
FIG. 10 is a schematic diagram of the throttle actuator as shown in FIG. 7, illustrating operation thereof when a failure occurs.

The throttle actuator may fail, for example, if the motor 36 fails to perform predetermined throttle operation due to a fault in the motor 36, such as fixation of parts or breakage of wire, or an accident in the control unit which controls the rotation of the motor 36. These faults can be detected by sensing a conflict between throttle opening signals from the sensor (not shown) which detects the throttle opening and throttle opening command signals output from the control unit (not shown) to the motor 36. If any one of these faults is detected, the electromagnetic clutch 35 is disengaged so as not to transmit the torque of the motor 36 to the throttle valve 5, as shown in FIG. 10. Thus, the throttle is operated exclusively by means of the accelerator pedal 50 so that normal cruising can be continued after the throttle actuator fails.

If the amount of the initial deformation of the coupler spring 14 is set so that the torque generated by the initial deformation thereof is larger than the torque which the valve returning spring 13 generates when the throttle valve 5 is fully open (the maximum torque of the valve returning spring 13), the floating lever 15 can be moved together with the accelerator lever 16 over the entire range of the accelerator opening (the throttle opening). Delay in the response of the throttle valve 5 to the driver's accelerator pedal operation can thus be eliminated. In addition, since the maximum accelerator opening coincides with the maximum throttle opening, the driver can fully utilize the operable range of the throttle opening during failure of the throttle actuator.

Figure 11:
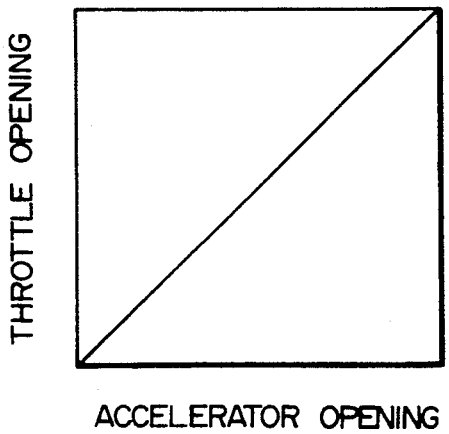
FIG. 11 is a graph showing the relationship between the accelerator opening and the throttle opening when a failure occurs.

The operation of the throttle valve 5 immediately after the disengagement of the electromagnetic clutch 35 will be considered below. If the throttle opening is larger than the accelerator opening as shown in FIG. 7 before disengaging the electromagnetic clutch 35, the throttle valve 5 is returned to the position of the floating lever 15, i.e. the position of the accelerator lever 16, by means of the valve returning spring 13 as shown in FIG. 10. If the throttle opening is smaller than the accelerator opening as shown in FIG. 5 before disengaging the electromagnetic clutch 35, the throttle valve 5 is also returned to the position of the floating lever 15, i.e. the position of the accelerator lever 16, by the restoration force of the coupler spring 14 transmitted through the valve shaft lever 8. Thus, if the electromagnetic clutch 35 is disengaged, the throttle opening becomes equal to the accelerator opening, i.e. the position of the accelerator lever 16 which is operated by the driver. As a result, no accidental or sudden acceleration or deceleration is caused if the throttle actuator fails. As shown in FIG. 11, the accelerator opening/throttle opening characteristic during failure of the throttle actuator is substantially the same as the characteristic shown in FIG. 4.

As described above, the electromagnetic clutch 35 operates to connect the motor 36 and the throttle valve shaft 2 only when supplied with current, and it keeps the motor 36 and the throttle valve shaft 2 disconnected when not supplied with current. If a failure occurs in the motor 36 or the control unit, the connection of the motor 36 and the throttle valve 5 can be cut off simply by switching off the electromagnetic clutch 35, resulting in immediate operation of the above-described fail-safe function and/or limp-home function. In addition, failure of the electromagnetic clutch, for example, breakage of a power supply wire thereof, will not hinder normal driving because, in such a case, the electromagnetic clutch 35 is disengaged so that the throttle valve can be operated solely by means of the accelerator pedal 50.

Figure 12:
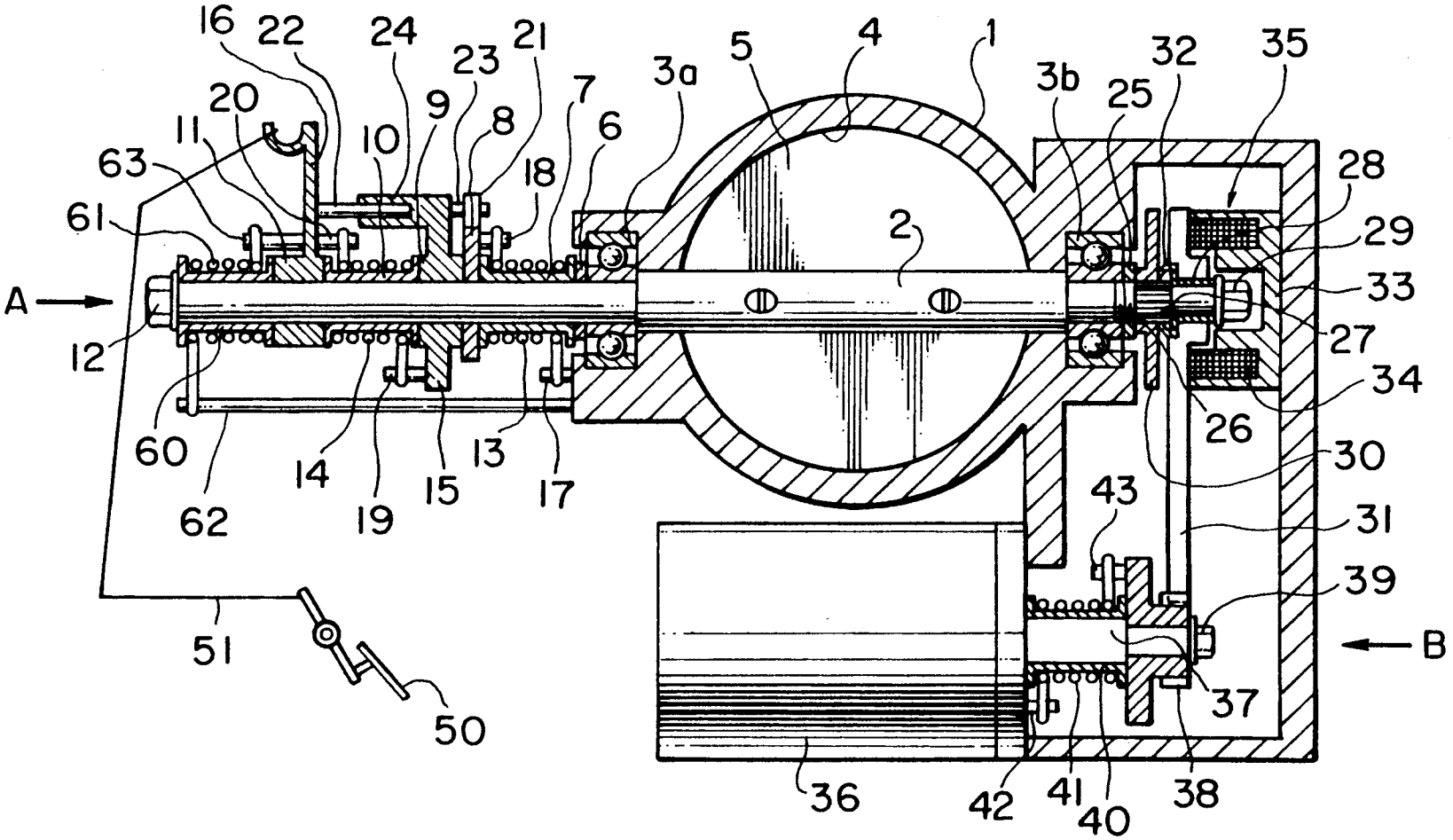
FIG. 12 is a longitudinal sectional view of a throttle actuator according to the second embodiment of the present invention.
Figure 13:
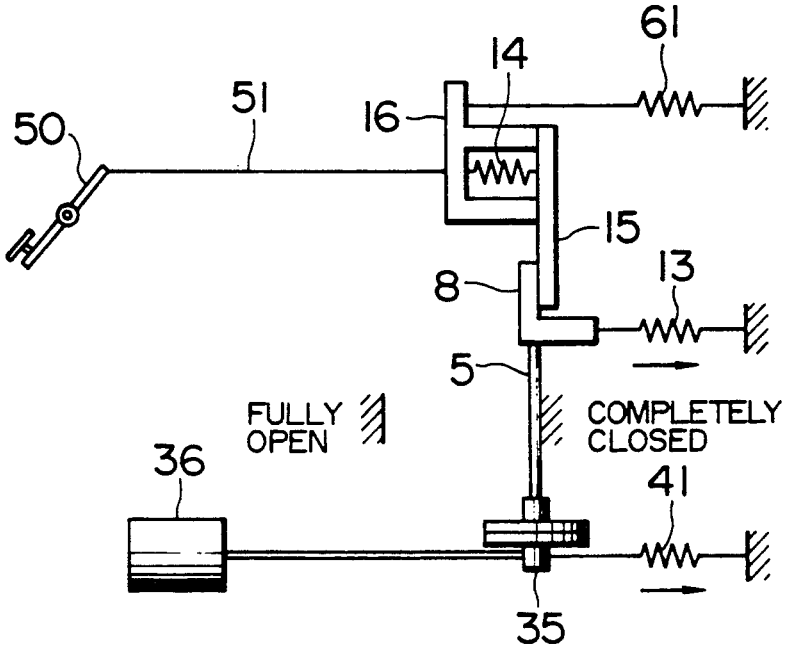
FIG. 13 is a schematic diagram of the throttle actuator shown in FIG. 12, illustrating operation thereof when an electromagnetic clutch fails to disengage.
Figure 14:
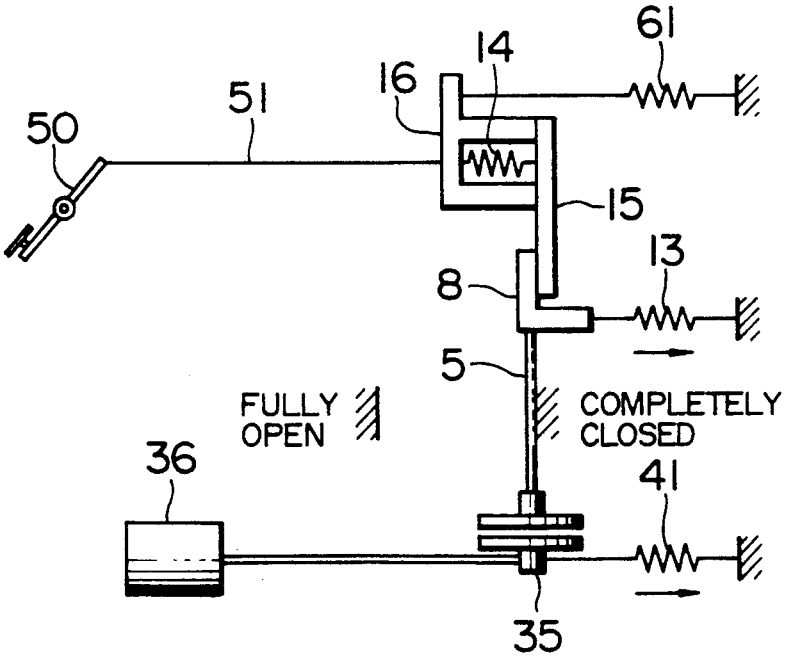
FIG. 14 is a schematic diagram of the throttle actuator, illustrating operation thereof when the electromagnetic clutch operates normally.

A throttle actuator according to the second embodiment of the present invention will be described hereinafter with reference to FIGS. 12, 13 and 14.

The differences in construction from the first embodiment as shown in FIG. 1 are as follows. In the second embodiment as shown in FIG. 12, a spring collar 40 is provided on a motor shaft 37, and a motor returning spring 41 is provided on the circumference of the spring collar 40. One end portion of the motor returning spring 41 is stopped by a pin 42 which is rooted in the body of a motor 36, and the other end portion thereof is stopped by a pin 43 rooted in a pinion 38. The motor returning spring 41 applies torque to the motor shaft 37 in a direction such that a throttle valve 5 closes (counterclockwise when viewed from the direction indicated by an arrow B).

The main difference from the first embodiment is in the operation performed when the electromagnetic clutch 35 fails. If it fails to disconnect the motor 36 from a throttle valve shaft 2, the control operated by the motor 36 is discontinued by switching off the motor 36 to allow the motor shaft 37 to freely rotate together with the throttle valve shaft 2 when the throttle valve shaft 2 is rotated by the acceleration pedal operation. In this case, many parts rotate: a sector gear 31, the pinion 38 and the motor shaft 37, in addition to the throttle valve shaft 2 and the throttle valve 5. Thus, the moment of inertia becomes substantially large.

In the first embodiment, since the torque for closing the throttle valve 5 is generated only by the valve returning spring 13, an increased moment of inertia will likely result in a longer time required to close the throttle valve 5. Despite an increased moment of inertia, the throttle valve 5 can be closed quickly in response to the movement of the acceleration pedal 50 if the spring constant of the valve returning spring 13 is substantially large. However, in this case and in the case where the electromagnetic clutch 35 operates normally to disconnect the motor 36 from the throttle valve shaft 2, the stepping force on the accelerator pedal 50 which is required to operate the throttle valve 5 increases.

According to the second embodiment, even if the electromagnetic clutch 35 fails to disconnect the motor 36 from the throttle valve 5 and, as a result, the moment of inertia is increased, response delay of the throttle valve 5 is prevented because the motor returning spring 41, as well as the valve returning spring 13, generates torque for closing the throttle valve 5. The operation in this case is illustrated in FIG. 13. If the electromagnetic clutch 35 operates normally to disconnect the motor 36, the stepping force required on the accelerator pedal 50 does not increase because the valve returning spring 13 alone, not the motor returning spring 41, creates the torque for closing the throttle valve 5.

If the torque generated by the initial deformation of a coupler spring 14 is larger than the sum of the torques which the valve returning spring 13 and the motor returning spring 41 generate when the throttle valve 5 is fully open, the floating lever 15 can be moved together with the accelerator lever 16 over the entire range of the accelerator opening (the throttle opening). Delay in the response of the throttle valve 5 to the driver's accelerator pedal operation can thus be eliminated. In addition, since the maximum accelerator opening coincides with the maximum throttle opening, the driver can fully utilize the operable range of the throttle opening after the throttle actuator fails.

It is preferable that a failure of the motor or the like be communicated to the driver, for example, by means of an indicator.

During normal operation of a throttle actuator according to the present invention, the electromagnetic clutch is kept engaged so that the motor will take the main role in throttle operation. A difference between the amount of operation caused by the action of the accelerator pedal and the amount of operation caused by the motor is offset by the relationships between the set positions of floating lever and the coupler spring and between the set positions of the floating lever and the valve shaft lever. Thus, the throttle control performed by the motor does not cause any undesired impact on the driver.

If the motor or the control unit which drives the motor fails, the fail-safe function and/or the limp-home function safeguard normal driving conditions. The electromagnetic clutch disconnects the motor from the throttle valve shaft so that the throttle can be controlled solely by means of accelerator pedal. Thus, normal driving can be continued after such a failure occurs.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A throttle actuator comprising:
a body which forms an intake passage;
a throttle valve shaft supported by said body;
a throttle valve which is connected to said throttle valve shaft and which adjusts the opening and closing of said intake passage; and
an electronically controlled motor for adjusting the position of said throttle valve to open and close said intake passage in accordance with a throttle operation which is performed by means of an accelerator pedal,
wherein said throttle valve shaft comprises:
a valve shaft lever for rotating said throttle valve shaft;
an accelerator lever which is operated by said accelerator pedal;
a floating lever which is positioned between said valve shaft lever and said accelerator lever and which transmits torque to said valve shaft lever in a direction causing said throttle valve to open;
a valve returning spring which applies torque to said throttle valve shaft in a direction causing said throttle valve to close; and
a coupler spring which pulls said accelerator lever and said floating lever toward each other.

2. A throttle actuator according to claim 1, wherein said throttle valve shaft further comprises an accelerator lever returning spring which applies torque to said accelerator lever in a direction causing said throttle valve to close.

3. A throttle actuator comprising:
a body which forms an intake passage;
a throttle valve shaft supported by said body;
a throttle valve which is connected to said throttle valve shaft and which adjusts the opening and closing of said intake passage; and
a motor which applies torque to said throttle valve shaft to control the opening and closing of said intake passage by adjusting the position of said throttle valve;
wherein said throttle valve comprises:
a valve shaft lever for rotating said throttle valve shaft;
an accelerator lever which is operated by an accelerator pedal;
a floating lever which is positioned between said valve shaft lever and said accelerator lever and which transmits torque to said valve shaft lever in a direction causing said throttle valve to open;
a valve returning spring which applies torque to said throttle valve shaft in a direction causing said throttle valve to close;
a coupler spring which pulls said accelerator lever and said floating lever toward each other; and
an accelerator lever returning spring which applies torque to said accelerator lever to close said throttle valve.

4. A throttle actuator comprising:
a body which forms an intake passage;
a throttle valve shaft;
a throttle valve which is connected to said throttle valve shaft and which adjusts the opening of said intake passage; and
a motor which applies torque to said throttle valve,
wherein said throttle valve shaft is provided with:
a valve shaft lever which is operated by means of an accelerator pedal;
a floating lever which is positioned between said valve shaft lever and said accelerator lever and which transmits a torque to said valve shaft lever in such a direction that said throttle valve opens;
a valve returning spring which applies torque to said throttle valve shaft in such a direction that said throttle valve closes;
a coupler spring which pulls said accelerator lever and said floating lever toward each other; and
an accelerator lever returning spring which applies torque to said accelerator lever in such a direction that said throttle valve closes,
wherein the spring constant of said coupler spring is smaller than the sum of the spring constants of said valve returning spring and said accelerator lever returning spring.

5. A throttle actuator comprising:

a body which forms an intake passage;

a throttle valve shaft;

a throttle valve which is connected to said throttle valve shaft and which adjusts the opening of said intake passage; and a motor which applies torque to said throttle valve shaft;

wherein said throttle valve shaft is provided with:

a valve shaft lever;

an accelerator lever which is operated by an accelerator pedal;

a floating lever which is positioned between said valve shaft lever and said accelerator lever and which transmits a torque to said valve shaft lever in such a direction that said throttle valve opens;

a valve returning spring which applies torque to said throttle valve shaft in such a direction that said throttle valve closes;

a coupler spring which pulls said accelerator lever and said floating lever toward each other; and an accelerator lever returning spring which applies torque to said accelerator lever in such a direction that said throttle valve closes, wherein torque generated by the initial deformation of said coupler spring so as to pull said accelerator lever and said floating lever toward each other is greater than said valve returning spring torque generated when said throttle valve is fully open.

6. A throttle actuator according to claim 3, further comprising a motor returning spring which applies to said motor torque which causes said throttle valve to close.

7. A throttle actuator comprising:

a body which forms an intake passage;

a throttle valve shaft supported by said body;

a throttle valve which is connected to said throttle valve shaft and which adjusts the opening and closing of said intake passage by adjusting the position of the throttle valve; and a motor which applies torque to said throttle valve shaft to control the opening and closing of said intake passage, by adjusting the position of said throttle valve;

wherein said throttle valve shaft comprises:

a valve shaft lever for rotating said throttle valve shaft;

an accelerator lever which is operated an accelerator pedal;

a floating lever which is positioned between said valve shaft lever and said accelerator lever and which transmits torque to said valve shaft lever to open said throttle valve;

a valve returning spring which applies torque to said throttle valve shaft causing said throttle valve to close;

an accelerator lever returning spring which applies torque to said accelerator lever causing said throttle valve to close;

a motor returning spring which applies torque to said motor causing said throttle valve to close; and a coupler spring which pulls said accelerator lever and said floating lever toward each other, wherein torque generated by the initial deformation of said coupler spring so as to pull said accelerator lever and said floating lever toward each other is greater than the sum of the torques which said valve returning spring and said motor returning spring generate when said throttle valve is fully open.

8. A throttle actuator comprising:

a body which forms an intake passage;

a throttle valve shaft supported by said body;

a throttle valve which is connected to said throttle valve shaft and which adjusts the opening and closing of said intake passage;

an electronically controlled motor for adjusting the position of said throttle valve to open and close said intake passage in accordance with a throttle operation which is performed by an accelerator pedal; and an electromagnetic clutch which is provided on said throttle valve shaft and which operates the torque transmission from said motor to said throttle valve shaft, wherein said electromagnetic clutch is disengaged when it is determined that a failure occurs in said electronically controlled motor, wherein said throttle valve shaft comprises:

a valve shaft lever for rotating said throttle valve shaft;

an accelerator lever which is operated by said accelerator pedal;

a floating lever which is positioned between said valve shaft lever and said accelerator lever and which transmits torque to said valve shaft lever to open said throttle valve;

a valve returning spring which applies torque to said throttle valve shaft to close said throttle valve; and a coupler spring which pulls said accelerator lever and said floating lever toward each other.

9. A throttle actuator according to claim 8, further comprising indicating means which communicates, to the driver, a failure message when it is determined that a failure has occurred in said electronically controlled motor.

10. A throttle actuator according to claim 8, further comprising a motor returning spring which applies torque to said motor to close said throttle valve.

* * * * *